US007726694B2

(12) United States Patent
Guillot

(10) Patent No.: US 7,726,694 B2
(45) Date of Patent: Jun. 1, 2010

(54) PERSONAL SAIL ASSEMBLY AND METHOD FOR USE IN CONJUNCTION WITH A MOBILE DEVICE

(76) Inventor: David F. Guillot, 53 Center St., Geneseo, NY (US) 14454

( * ) Notice: Subject to any disclaimer, the term of this patent is extended or adjusted under 35 U.S.C. 154(b) by 244 days.

(21) Appl. No.: 11/335,280

(22) Filed: Jan. 19, 2006

(65) Prior Publication Data

US 2007/0164550 A1 Jul. 19, 2007

(51) Int. Cl.
*A63C 5/11* (2006.01)

(52) U.S. Cl. ..... 280/810

(58) Field of Classification Search ..... 280/810, 280/809; 114/39.12, 39.16, 102.11; 135/97, 135/117, 143, 150, 156
See application file for complete search history.

(56) References Cited

U.S. PATENT DOCUMENTS

| | | | | |
|---|---|---|---|---|
| 302,517 | A * | 7/1884 | Nelson | 280/810 |
| 3,447,549 | A * | 6/1969 | Cunningham | 135/114 |
| 3,454,021 | A * | 7/1969 | Morris | 135/156 |
| 4,136,631 | A | 1/1979 | Nimchuk | |
| 4,186,680 | A | 2/1980 | Harpole | |
| 4,269,133 | A | 5/1981 | Brown | |
| 4,433,700 | A * | 2/1984 | Dohet | 135/97 |
| 4,531,763 | A * | 7/1985 | Toland | 280/810 |
| 4,533,159 | A * | 8/1985 | Seidel | 280/810 |
| 4,685,484 | A * | 8/1987 | Moneta | 135/87 |
| 4,978,140 | A | 12/1990 | Babson | |
| 5,024,866 | A * | 6/1991 | Goode | 428/36.4 |
| 5,366,182 | A * | 11/1994 | Roeseler et al. | 244/155 R |
| 5,448,961 | A | 9/1995 | Ansteensen | |
| 5,476,058 | A | 12/1995 | Wilson | |
| 5,924,732 | A | 7/1999 | Olsen | |
| 6,250,241 | B1 * | 6/2001 | Spengler | 114/102.11 |
| 6,615,758 | B2 | 9/2003 | Blad | |
| 6,776,115 | B1 | 8/2004 | De Meo | |
| 6,807,919 | B1 | 10/2004 | Thomsen | |

* cited by examiner

*Primary Examiner*—Frank B Vanaman
(74) *Attorney, Agent, or Firm*—Woods Oviatt Gilman LLP

(57) ABSTRACT

A user supported portable sail assembly and method uses the force of the wind to help propel a user on a mobile device such as skis, snowboards, skateboards, in-line or ice skates, for example, in a controlled and safe manner. A sail is attached to the ends of a pair of parallel, flexible poles which the user holds onto, usually one pole in each hand. The user orients the sail to optimize direction and speed. As the sail catches wind currents, the poles flex and form an optimal airfoil. Should the user wish to stop using the sail assembly, the user simply brings the poles together and brakes or glides to a gentle stop. The poles may be constructed of multiple interlocking segments for easy and quick disassembly and compact stowing.

6 Claims, 3 Drawing Sheets

Fig.4A
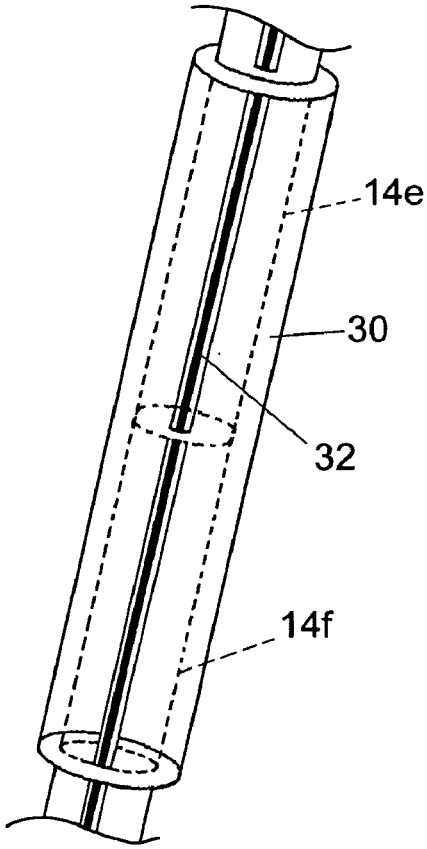
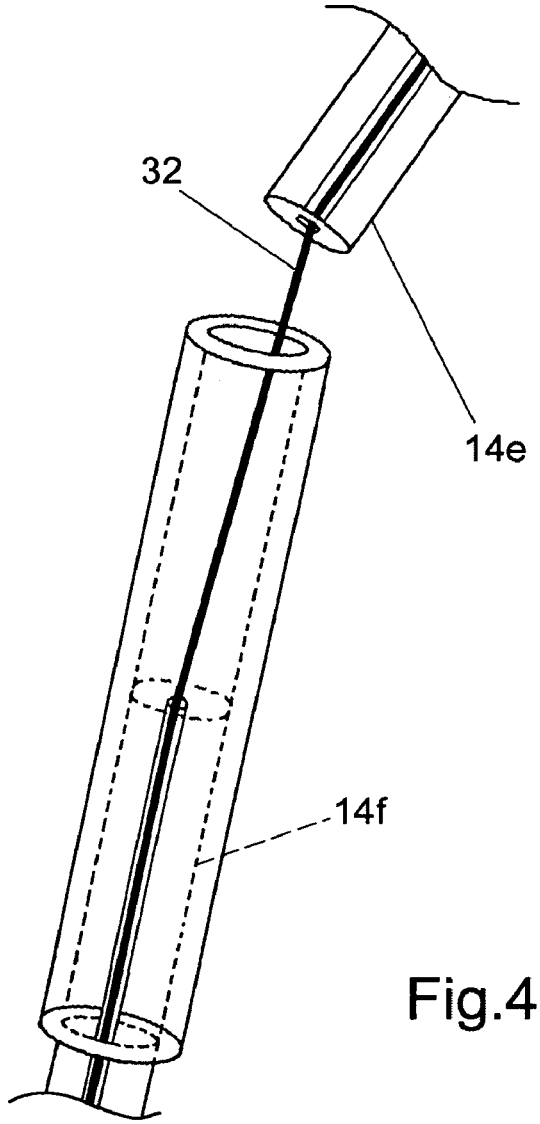
Fig.4B

PERSONAL SAIL ASSEMBLY AND METHOD FOR USE IN CONJUNCTION WITH A MOBILE DEVICE

BACKGROUND OF INVENTION

Extreme sports like skating, surfing, snowboarding and skateboarding have grown tremendously in popularity in the past few decades. The world of in-line skating and snowboarding has become mainstream as is evidenced in the growing number of televised events, video games and general world-wide interest on the subject. All sporting goods and toy stores sell a wide variety of skates and boards to be used on a variety of terrains for all seasons. Wide arrays of accessories including ramps, rails and slides have evolved in order to increase the fun and challenges that these sports provide. Of course a proportionate number of safety products like knee, palm and elbow guards and helmets have evolved to-keep up with the increased risk of injury during these highly popular activities.

As part of the evolution of these sports people are constantly finding ways to increase their thrills and experiences by combining technologies together. For example, the sport of windsurfing uses a sail attached to a surfboard. Similarly, new sports using hand-held sails in conjunction with ice-skates, in-line skates and skateboards have been recently introduced. Thus, while many of these mobile devices are powered by the person using them, it is sometimes desirable to have an auxiliary method of propulsion.

There remains a need for a personal sailing device that is affordable, safe, lightweight, and easy to use for the novice yet offering new challenges for those more experienced in the art of using personal mobile devices such as in-line skates, skateboards, ice skates, skis, snowboards, scooters, kayaks, and the like (hereinafter "personal mobile devices").

SUMMARY OF THE INVENTION

The present invention addresses the above need by providing a lightweight, portable, personal sail assembly for a user to hold while on a mobile personal device such as a skate board or in-line skates, for example. The sail assembly includes a sail connected to the ends of a pair of spaced, substantially parallel poles that the user holds onto, usually one in each hand. The poles may be provided in segments that are separable to allow the sail assembly to be packed into a compact arrangement when not in use. When in use, as wind fills the sail, the poles flex to allow the user to orient the sail assembly in a manner that achieves the desired propulsion. The user may move the poles further apart for more speed or closer together to slow down or stop. The sail may be attached to the ends of the poles in a manner allowing sliding movement of peripheral segments of the sail along limited lengths of a respective pole end. This feature enhances the sail's ability to change configuration and thus function according to the way in which the user handles the sail in the wind.

BRIEF DESCRIPTION OF THE DRAWINGS

FIGS. 4A, B are enlarged, fragmented, perspective views of how the poles may be formed in segments that may be separated yet remain interconnected by the elastic cord.

DETAILED DESCRIPTION OF A PREFERRED EMBODIMENT

Figure 1:
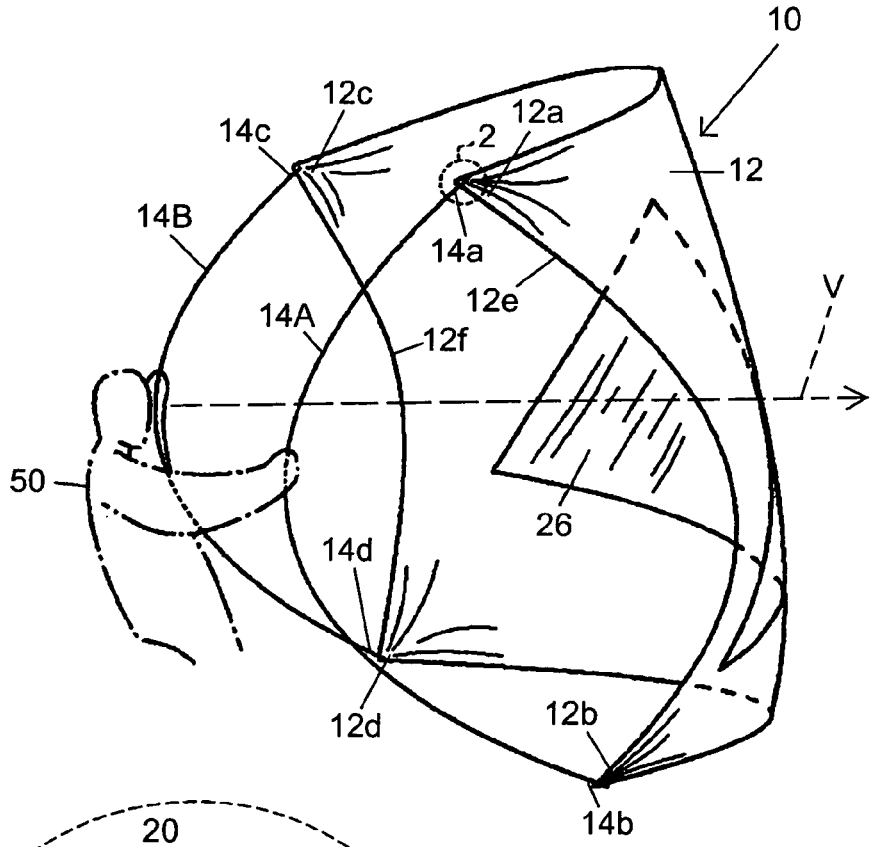
FIG. 1 is a perspective view of an embodiment of the personal sail assembly and method of use.

A preferred embodiment of the inventive sail assembly and method of use is illustrated in FIG. 1. The sail assembly 10 basically includes a flexible sail 12 affixed to first and second flexible poles 14A and 14B. Sail 12 may be constructed of any desired and appropriate wind harnessing material such as those used in the manufacturing of tents, kites, parachutes and conventional sails. Thus, materials such as flexible plastic, nylon, Dacron, and tarp, for example, are appropriate candidates for sail material 12. It is noted that sail 12 may be of any desired size and outline. Thus, shapes other than square or rectangular as illustrated in FIG. 1 are of course possible. Sail 12 may furthermore be completely or partly transparent to allow viewing therethrough by the user 50. For example, a transparent window 26 of any desired size and shape may be incorporated into sail 12 whereby user 50 can see through the sail as represented by line-of-sight arrow "V". It will be appreciated that this transparency allows greater visibility of the surrounding terrain and potential obstacles to the user 50 during use of the sail assembly 10. The sail 12 may furthermore be made of a single panel of material or a plurality of panels. The panels can be flat, concave, convex or billowed similar to a conventional spinnaker.

The flexible poles 14A, B may be made of any flexible, resilient material such as those used in the manufacturing of tent poles, kites or bows used in hunting. Thus, materials such as wood, plastic, graphite, KEVLAR, fiberglass, or a composite material, are appropriate candidates for the material from which poles 14A, B are manufactured. Each pole end 14*a-d* is attached adjacent a respective attachment point such as corner 12*a-d* of sail 12 such that poles 14A and 14B extend substantially parallel to one another adjacent opposite sides 12*e,f* of sail 12. Thus, while the sail attachment points or corners 14*a-d* are attached to the pole ends, sail sides 12*e*, 12*f* extending between corners 14*a*, 14*b*, and 14*c*, 14*d*, respectively, are not attached to the poles 14A,14B. This allows a large magnitude of billowing of sail 12 in the direction opposite to the flex of poles 14A, 14B as seen best in FIG. 1.

Figure 2:
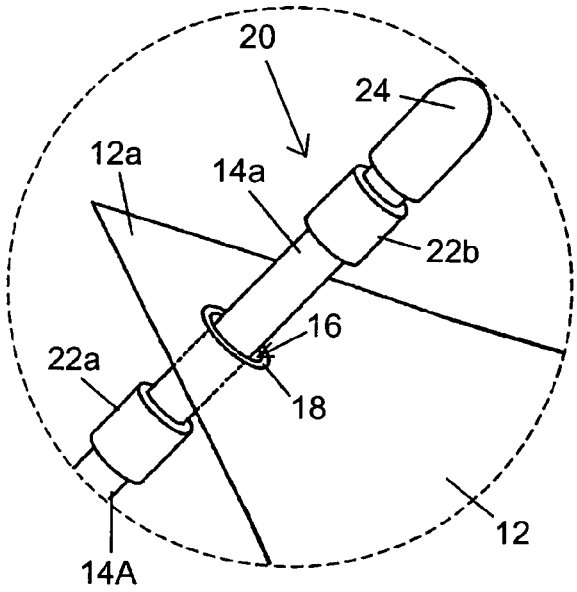
FIG. 2 is an enlarged, perspective view of the segment labeled reference numeral 2 in FIG. 1.

As seen best in FIG. 2, one possible method of sail attachment is to have pole end 14*a* extend through a hole 16 formed in the sail 12 adjacent a respective sail corner 12*a*. Each hole 16 is preferably reinforced by a grommet 18, for example. It is understood the construction of the sail assembly is preferably the same at each pole end 14*a-d*. The diameter of grommet 18 is larger than the diameter of the pole 14A such that grommet 18 may slide freely along pole 14A for purposes explained below. It is noted that poles 14A,B may be connected to sail 12 in any desired manner and may be similar to those techniques used to connect poles to material in the manufacturing of tents, collapsible camping furniture, kites and conventional sails, for example.

A sliding stop assembly 20 is provided adjacent pole end 14*a* and includes first and second stop elements 22*a,b* which are attached in longitudinally spaced relation to pole 14A. The spacing between stop elements 22*a,b* may vary as desired but is preferably between about 0 and 10 inches. A pole end cap 24 is provided at each pole end 14*a-d*. In one possible embodiment of the invention, the user may be provided with a variety of different types and sizes of sails 12. In this embodiment, the user may quickly change one sail 12 for another and at least stop element 22*b* is removable such that with stop element 22*b* and end cap 24 removed from the pole, the pole end may be passed through a respective hole and grommet 16,18. Stop element 22*b* and end cap 24 are then reattached to the pole with grommet 18 captured between stop elements 22*a* and 22*b*. As stated above, since the diameter of grommet 18 is larger than the pole 14A, the grommet 18 and sail material 12 which surrounds it may slide freely along pole 14A between stop elements 22*a* and 22*b*.

As seen in FIG. 1, the user 50 holds the sail assembly 12 with one pole in each hand while being supported by a mobile device (not shown in FIG. 1). Examples of mobile devices that may used in connection with sail assembly 10 include such things as roller skates, roller blades, snow skates, shoe skates, ice skates, ice board, surfboard, skateboard, snowboard, mountain board, skis, water-skis, snow skis, ice-boat, water boat, raft, kayak or canoe. The user 50 orients sail assembly 10 in order to capture an optimal amount of wind depending on the user's speed and direction needs. As the wind fills the sail material 12, the poles 14A and 14B flex providing smooth acceleration and deceleration rates. The user 50 can also control the shape or tautness of the sail material 12 by spreading his arms wide or bringing them closer together while holding poles 14A. 14B. If the user wants to tack or run close to the wind, the user can tighten the sail material 12 by spreading his/her arms apart. If, however, the user wishes to run with the wind, he/she can bring his/her arms closer together providing just the right amount of slack to the sail material 12. If the wind gets too strong or the user wants to stop using the wind, he/she simply brings the poles together and wraps the sail 12 partially so as to gently roll to a stop effortlessly and safely.

Referring now to FIGS. 3A-D and 4A, B, the manner of disassembling sail assembly 10 for transport will now be described. In order to make the sail assembly 10 more compact when not in use, each pole 14A, B may be separable into at least first and second pole segments 14*e* and 14*f*, although each pole may be separable into as many segments as desired. In the assembled condition seen in FIG. 4A, pole segments 14*e,f* are arranged in colinear relationship and releasably secured together by a connecting sleeve 30. Connecting sleeve 30 is preferably fixed at one end thereof (e.g., by crimping) to one of the two pole segments (in FIG. 4B, connecting sleeve 30 is fixed to pole segment 14*f*) to increase the stability of the assembly. An elastic cord 32 extends continuously though each pole segment 14*e,f* with the ends of the cord secured to the free ends 14*a*, 14*b* of the pole segments 14*e*, 14*f*, respectively. Elastic cord 32 is thus always under tension and acts to urge the pole segments 14*e,f* together in the collinear, assembled condition seen in FIG. 4A.

Figure 3A:
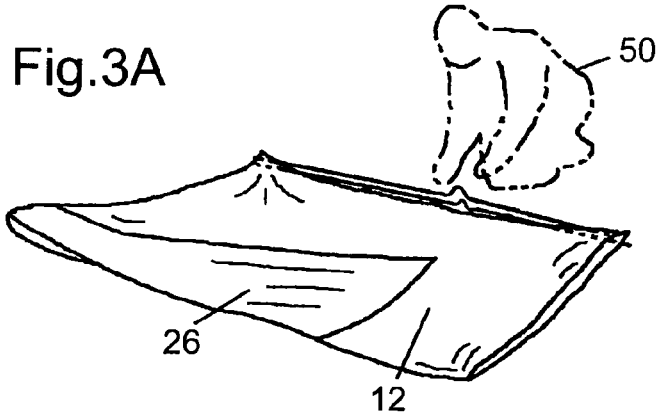
FIGS. 3A-D are perspective views of the sail of FIG. 1 being folded by user.
Figure 3B:
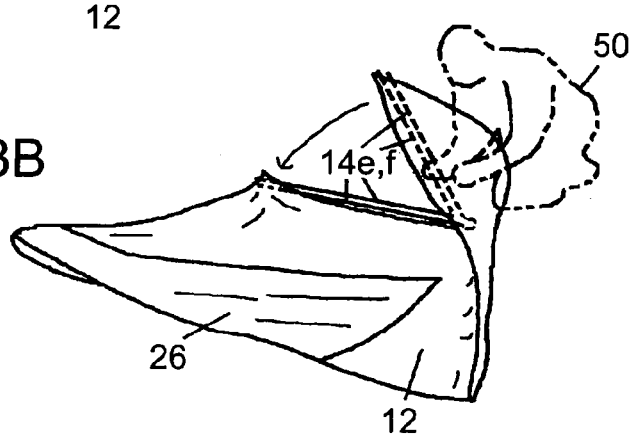
Figure 3C:
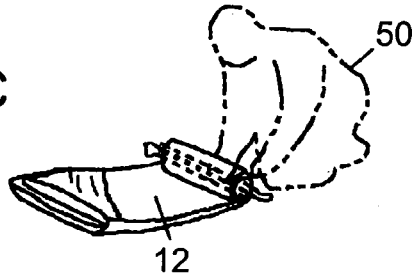
Figure 3D:
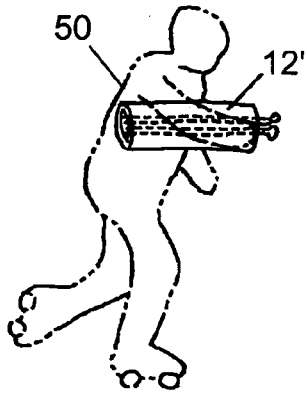

When the sail assembly 10 is not in use, it may be quickly disassembled by pulling the pole segments apart at the connecting sleeve 30. As seen in FIG. 4B, this is done be manually grasping one pole segment 14*e* and pulling it away from pole segment 14*f* and connecting sleeve 30 under the tension of cord 32. The pole segment 14*e* is then moved into adjacent, parallel relationship to the pole segment 14*f*. Thus, as seen in FIG. 3A, a user 50 begins disassembling sail assembly 10 by folding the sail material 12 over itself and bringing poles 14A and 14B together in adjacent, parallel relationship. As seen in FIG. 3B, user 50 proceeds by disconnecting all pole segments and placing them in adjacent, parallel relationship. Once all pole segments have been disconnected, the user 50 starts rolling up the sail material 12 about the pole segments as seen in FIG. 3C. The result is a compact, disassembled sail assembly 12' that the user 50 may easily carry away as seen in FIG. 3D. To reassemble sail assembly 12, the reverse process is simply carried out, i.e., the sail 12 is unrolled and the pole segments are attached together at their respective connecting sleeves 30.

This preferred embodiment allows the sail assembly 10 to be disassembled quickly to a very small size for travel or stowing while remaining one interconnected unit. It will thus be appreciated that the portable sail assembly 10 of the invention provides a fun, safe, and economical way for a person of almost any age to experience the joy of using the power of the wind when used in conjunction with a personal mobile device.

What is claimed is:

1. A hand-held sail assembly for propelling a user in the direction of a wind, comprising:

a) a sail of flexible material having front and back surfaces surrounded by a peripheral edge defining first and second pairs of corners, said sail including first and second pairs of pole attachment points located adjacent said first and second pairs of corners, respectively, each of said attachment points comprising a hole formed through said sail from said front to said back surfaces thereof; and b) first and second substantially flexible poles each having first and second ends, said first and second ends extending through a respective said hole in said sail, with said first and second poles extending in substantially parallel relationship, the portions of said peripheral edge of said sail between said first and second ends of each of said poles being unattached to a respective said pole such that said sail may billow in a direction opposite to the flex of said first and second poles and thereby propel a user of said sail assembly in the direction of the wind; and c) a sliding stop assembly mounted adjacent each of said first and second ends of each of said first and second poles, each of said sliding stop assemblies having first and second stop elements mounted in longitudinally spaced relation on a respective pole, said sail attached to said first and second poles with said sail pole attachment points positioned and captured between said first and second stop elements of a respective sliding sail stop assembly whereby said pole attachment points are freely slidable between each of said first and second stop elements.

2. The sail assembly of claim 1 wherein said holes are each reinforced with a grommet.

3. The sail assembly of claim 1, wherein said sail is of substantially rectangular outline.

4. The sail assembly of claim 1 wherein said sail material is at least partly transparent.

5. The sail assembly of claim 1 wherein said first and second poles each include first and second, separable pole segments interconnected by a cord, said first and second pole segments being colinear when attached together and movable to a parallel, side-by-side relation yet still interconnected by said cord when in the separated condition.

6. The sail assembly of claim 5 wherein said first and second pole segments are of substantially the same length.

* * * * *